US008297019B2

(12) United States Patent
Lorenz

(10) Patent No.: US 8,297,019 B2
(45) Date of Patent: Oct. 30, 2012

(54) MOUNTING BRACKET FOR WALL INSULATION

(75) Inventor: Thomas Lorenz, Wallenhorst (DE)

(73) Assignee: Lorenz Kunststofftechnik GmbH, Wallenhorst (DE)

( * ) Notice: Subject to any disclaimer, the term of this patent is extended or adjusted under 35 U.S.C. 154(b) by 0 days.

(21) Appl. No.: 13/015,055

(22) Filed: Jan. 27, 2011

(65) Prior Publication Data

US 2011/0185659 A1 Aug. 4, 2011

(30) Foreign Application Priority Data

Jan. 29, 2010 (DE) ..... 20 2010 000 104 U
Mar. 12, 2010 (DE) ..... 10 2010 011 168

(51) Int. Cl.
*E04B 1/38* (2006.01)
*E04C 1/40* (2006.01)

(52) U.S. Cl. ..... 52/511; 52/407.4

(58) Field of Classification Search ..... 52/235, 52/407.4, 404.2, 506.2, 511, 712, 838; 248/247, 248/248, 300

See application file for complete search history.

(56) References Cited

U.S. PATENT DOCUMENTS 2,256,961 A * 9/1941 Pearson et al. ..... 52/407.4
3,966,056 A * 6/1976 Larson ..... 211/134
4,011,700 A * 3/1977 Sado ..... 52/235
4,517,776 A * 5/1985 Barker ..... 52/90.1
6,131,360 A * 10/2000 Dalen ..... 52/712
6,430,890 B1 * 8/2002 Chiwhane et al. ..... 52/715
6,883,578 B2 * 4/2005 Whitley ..... 160/133

FOREIGN PATENT DOCUMENTS

DE 202007009780 U1 11/2007

* cited by examiner

*Primary Examiner* — Brian Glessner
*Assistant Examiner* — Paola Agudelo
(74) *Attorney, Agent, or Firm* — Patricia M. Mathers

(57) ABSTRACT

Disclosed is a mounting bracket for mounting wall insulation to an exterior wall. The mounting bracket is a unitary piece constructed of plastic, having a vertical wall plate, a horizontal support plate that extends orthogonal to the wall plate, and a vertical reinforcing plate that extends orthogonal to the vertical wall plate and the horizontal support plate. A bore is provided in the wall plate, for fastening the mounting bracket to the exterior wall. The reinforcing plate extends beyond the length of the horizontal support plate, to provide a mounting flange that may be fastened to a vertical wall support, such as a roof batten. The area formed by the horizontal support plate and an upper portion of the wall plate provides an unobstructed support area for supporting the wall insulation.

7 Claims, 3 Drawing Sheets

MOUNTING BRACKET FOR WALL INSULATION

This application claims priority from German Patent Applications DE 10 2010 011 168.6, filed on 12 Mar. 2010 and DE 20 2010 000 104.8, filed on 29 Jan. 2010.

BACKGROUND INFORMATION

1. Field of the Invention

The invention relates to a mounting bracket for wall insulation.

2. Description of the Prior Art

In many areas, it is necessary or makes sense to add additional insulation to the exterior walls of a building. One way of doing this is to mount insulation elements of up to 160 mm in thickness to the exterior side of the building, and then apply a layer of stucco over insulation elements, which have been affixed to the wall.

It also known to affix façade panels, which must be held to the wall of the building by means of appropriate mounting fixtures, on the outside front of the insulation elements that have been arranged on the exterior wall of a building. These mounting fixtures for the façade panels are frequently constructed as multi-part components and therefore require a relatively large storage area. They are also difficult to handle when installing.

DE 71 07 253 U discloses an anchoring kit for affixing façade panels that are to be mounted freely suspended in front of a building wall. For this application, stainless steel consoles are suggested, which comprise a welded construction made of several components.

DE 30 05 315 A1 teaches a mounting device which can be attached to a building wall and should then support a horizontally extended support for a façade construction. In contrast to simple angle profiles, a considerably more stable—for example, rigid—mounting device is to be created. To this end, a sheet steel element that has been notched and bent several times is suggested. Starting from an upright angular plate, two side plates of which form the wall plate and reinforcing plate in terms of the present proposal, a cut is provided in the reinforcing plate so that a part of this reinforcing plate can be bent to form a horizontal support plate. A portion of the reinforcing plate is left extending upwards beyond the support plate. Two cuts are made in the horizontal support plate, and the metal strip formed by the cuts between them is bent to an S, thereby creating a clamp spring by stamping and bending processes. The aforementioned horizontal support for the façade construction can be clamped tight between the support plate and the clamp spring.

It is generally the case that the building wall, to which the insulation and the new façade are to be applied, is not exactly even, but is rather curved or rippled. This is especially true in retrofitting insulation to older buildings, Depending upon the construction materials of the building wall, façade irregularities can seem quite inconspicuous in a superficial examination. If, however, the new façade follows the contour of the building wall, the curviness or rippling can become clearly visible in the new façade, to an unacceptable degree. In practice, therefore, it is desirable for the mounting devices, which are fastened to the existing building wall and are all the same length, to be shortened by varying amounts before applying the new façade. This can be accomplished, for example, by using a commercially available laser device, for example, a rotating laser. The ends of the mounting devices created in this manner are all on one plane, so that the new façade attached to them also lies on a flat plane. It is, however, not possible to perform such onsite shortening of steel mounting elements that are already mounted onto the building wall. Furthermore, steel mounting elements act as good heat conductors.

DE 20 2007 009 780 U1 teaches a generic mounting bracket that is made of plastic and serves as a retainer for façade components of rear-ventilated façades. The mounting brackets allow for the insulation or thermal barrier to be installed between the building wall and the façade elements after the mounting brackets have been mounted onto the building wall. In order to mount the heat insulation elements, the leading edge of the mounting bracket, namely, the leading edge of the vertically aligned reinforcing plate, is constructed as a blade, so that the heat insulation element can literally be skewered onto the mounting element. Several ribs are distributed along the height of the reinforcing plate. The ribs are aligned horizontally and become wider in the direction of the wall plate.

The selection of an injection-moldable plastic material and the thereby associated manufacturing process enable these generic mounting brackets to be cost effectively manufactured. The shortening of such a mounting bracket would cause the front cutting edge to be cut off. Depending upon the material used for the heat insulation, for example, in the case of insulating panels made of fibers, it is possible that the insulating panels cannot be skewered if, namely, they do not inherently possess the rigidity this requires.

BRIEF SUMMARY OF THE INVENTION

The underlying object of the invention is to improve a generic mounting bracket in such a way to enable easy installation of the insulation.

This object is achieved by means of a mounting bracket that includes a vertical wall plate, a vertical reinforcing plate that extends orthogonal to the plane of the wall plate, and a horizontally aligned support plate that is supported on the reinforcing plate. The wall plate has a bore for a fastening means and is to be mounted on the actual building wall. The support plate is shortened relative to the length of the reinforcing plate. The extending portion of the reinforcing plate serves as a batten mounting flange. The mounting bracket is a single-piece unitary piece constructed of plastic material. Providing the support plate above the reinforcing plate makes it possible to easily place a panel insulation material onto the mounting bracket.

The wall plate has a bore for receiving a mounting means, for example, a screw. An upright extending façade support, for example, a roof batten, is fastened to the opposite end of the mounting bracket, i.e., to the batten mounting flange, whereby the horizontal support plate preferably extends into the actual layer of insulation, thereby providing support for it. In practical application, this reach of the support plate into the insulation panel or mat is facilitated by cutting into insulation panel or mat with a knife or something similar in the area into which the support plate is supposed to extend. Multiple ribs are not provided one above the other on the same mounting element; instead, there is only the one support plate, so quick work progress is easily possible.

Bores for receiving mounting screws or other fastening means can be made in the mounting flange the roof battens or similar vertical reinforcing elements be attached to the mounting brackets by means of the screws or fastening means. Because the mounting bracket is made of plastic, the use of appropriate screws, such as self-tapping screws, may be a time-saving measure, because the vertical reinforcing element may be screwed onto the mounting bracket directly through the plastic material, without bores having first been made in the mounting bracket.

The support plate may be formed to extend on both sides of the reinforcing plate in such a way that support and reinforcing plates form a T-shaped profile. This ensures symmetrical load of the mounting bracket when the insulation is lying on the support plate.

Alternatively, the support plate may extend over only one side of the reinforcing plate, so that both form a profile that resembles an upside-down L. This makes allows particularly simple embodiment of the mold to be used to produce the mounting bracket, thereby facilitating the most cost effective embodiment of the mounting bracket. In particular, the reinforcing plate may be constructed such, that it does not join at the center of the wall plate, but rather to one side of the wall plate. Forming the bracket as an upside-down L makes it possible to place one side of this profile directly on an upright extending façade support without causing—for example, in the case of a T-shaped profile—a lateral overhang on the side of the profile that would hamper the attachment of the façade support to the mounting bracket. This is particularly true if the mounting bracket has been shortened and the mounting flange that was initially provided is missing. The mounting flange initially extended as an elongation of the reinforcing plate in front of the T-shaped profile, that is, in front of the support plate of the mounting bracket.

The support plate is advantageously constructed to be as wide as the wall plate, so that the mounting bracket has a certain width that is used to the maximum extent, if the support plate has this same maximum width. This is done to provide the widest possible support for the insulation and thereby prevent the insulation panels or insulation mats from settling.

It can hereby be particularly advantageous that the support plate has this maximal width along its entire length, in order to provide the largest possible support surface for the insulation.

The wall plate that serves to fasten the bracket to the building wall can advantageously be constructed with greater material thickness in the area around the bore for receiving the mounting means, in order to prevent the wall plate from being pulled out or broken in this area, whereas the wall plate may support a most economical construction of the mounting bracket by otherwise using a comparatively thinner material.

The horizontal support plate and/or the vertical reinforcing plate may advantageously be constructed with greater material thickness where it attaches to the wall plate than in other areas, to achieve the necessary strength in this area that supports a particularly high loading, whereas the most cost-effective construction of the mounting bracket is supported by using otherwise thinner material.

Roof battens are repeatedly mentioned below merely as an example of this type of support, which also includes battens and wall studs. The battens preferably extend over the entire height of the façade being erected. The mounting flange fits close up against the batten and can be fastened to it, for example, screwed to it. Both a T-shaped or an L-shaped cross-section of the reinforcing and support plate have a mounting flange that extends out toward the front, making it is easily possible to attach the battens optionally to the right or the left side of the mounting bracket by means of this flange.

Roof battens are repeatedly mentioned below merely as an example of this type of support. The roof battens preferably extend over the entire height of the façade being erected. The mounting flange fits close up against the roof batten and can be fastened to it, for example, screwed to it. Both a T-shaped or an L-shaped cross-section of the reinforcing and support plate have a mounting flange that extends out toward the front, making it is easily possible to attach the roof battens optionally to the right or the left side of the mounting bracket by means of this flange.

Advantageously, mounting bores can be provided in the mounting flange. The bores serve as retainers for fastening elements, for example, screws for securing to the vertical façade supports, for example, the aforementioned roof battens. In most applications, if, namely, the mounting bracket does not have to be shortened, these bores can be used to screw the roof battens particularly quickly and easily to the mounting bracket. Since the mounting bracket is made of plastic, in the case of shortened mounting brackets in which the factory-provided mounting bores can no longer be used, new mounting bores can be easily provided on site, for example, using a cordless drill. Depending upon the screws that are used, they may also be able to be screwed directly through the material of the mounting flange into the vertical façade support without first having to bore a new bore in the mounting bracket.

The proposed mounting bracket exhibits a stability that enables a rear-ventilated façade arrangement in which the façade is not supported against on the ground, but rather terminates above the ground, that is, is arranged freely suspended in front of the building wall, so that the mounting bracket alone supports the weight of the façade. The façade panels are used in this manner to protect the insulation against precipitation, basically keep the insulation dry, and thus ensure its heat-insulating properties.

An air layer is provided between the façade panels and the insulation in order to ensure that moisture caused by condensation or other influences can be reliably removed by ventilation. The upright façade supports can be placed in the proximity of this air layer. They form a kind of fence with a number of upright bars, behind which the insulation is arranged. Because the insulation panels or mats are wider than the space between the upright supports, the supports ensure that the insulation panels or mats remain in their preset arrangement on the building wall.

BRIEF DESCRIPTION OF THE DRAWINGS

Embodiments of the invention are explained below with reference to the drawings and the description.

DETAILED DESCRIPTION OF THE INVENTION

Figure 1:
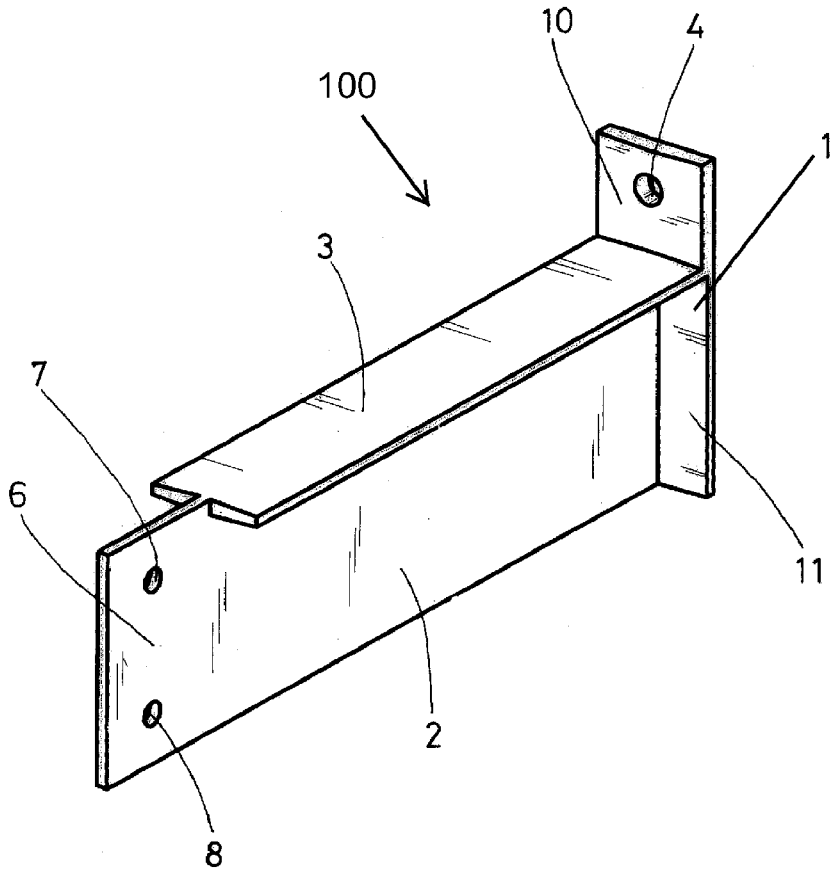
FIG. 1 is a perspective view of a first embodiment of a mounting bracket according to the invention, showing a T-profile formed by the support place and reinforcing plate.
Figure 2:
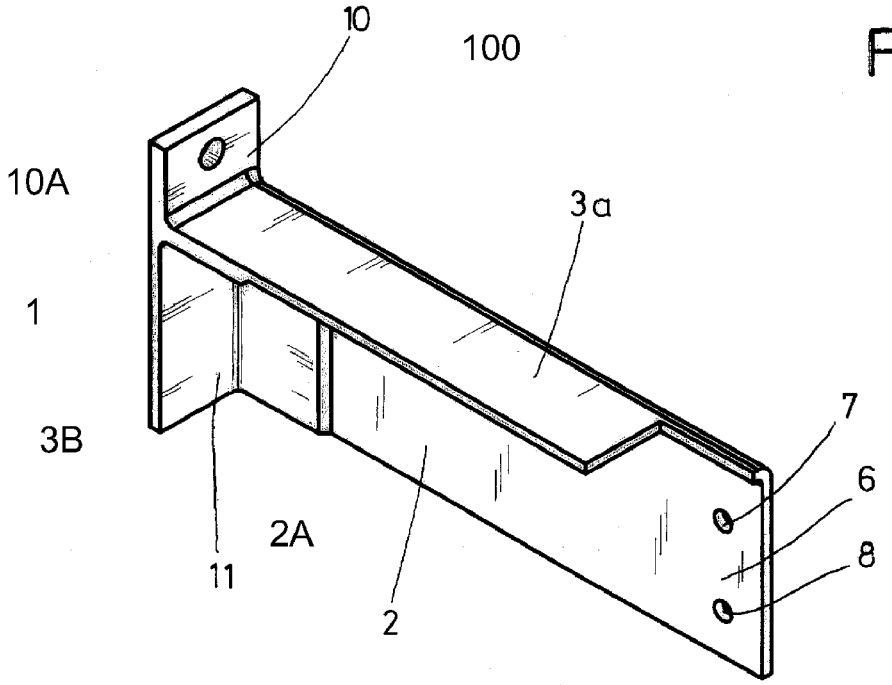
FIG. 2 is a perspective view of a second embodiment of a mounting bracket according to the invention, showing an upside-down L-profile formed by the support place and reinforcing plate.
Figure 3:
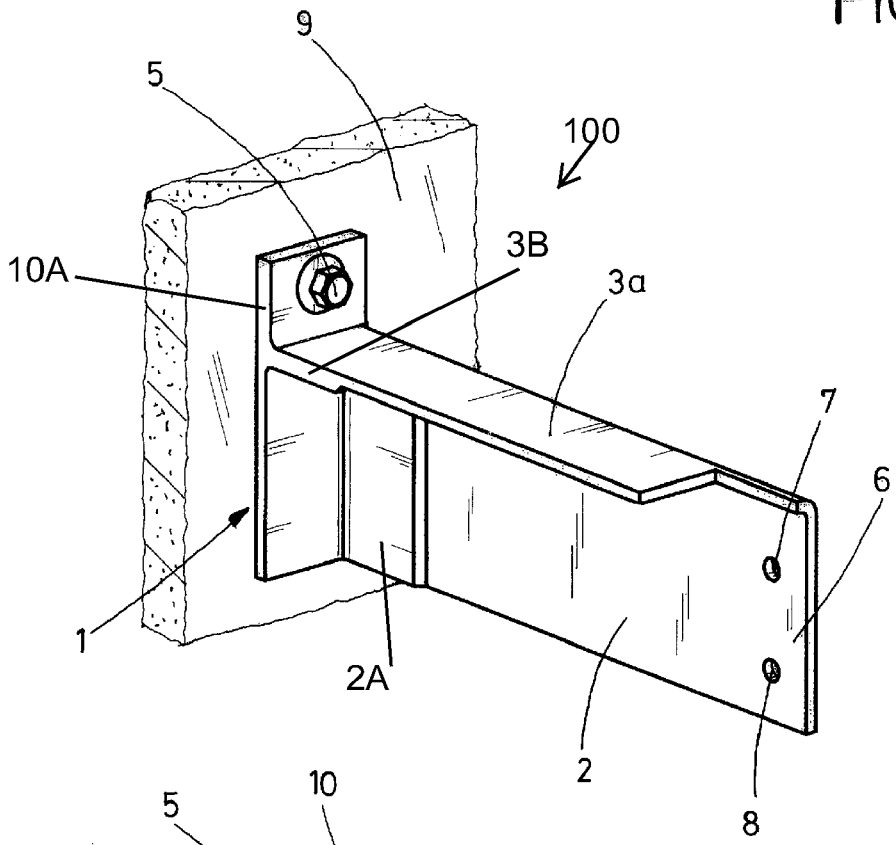
FIG. 3 is a perspective view of the mounting bracket of FIG. 2 mounted on a wall.
Figure 4:
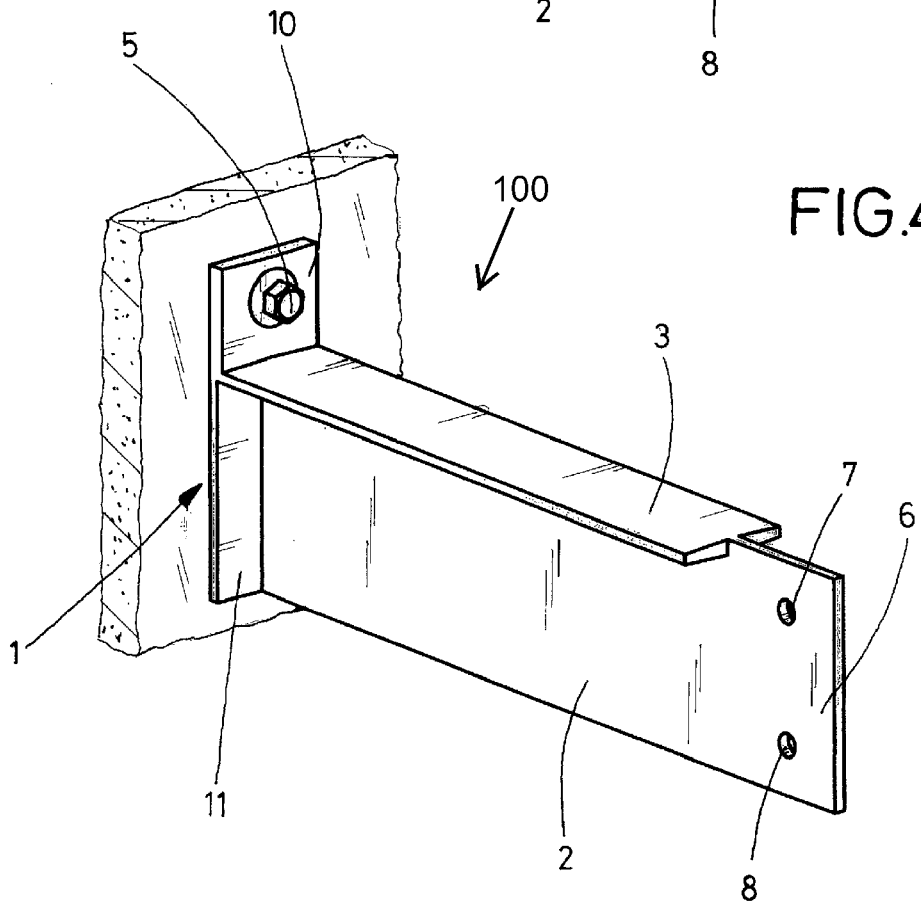
FIG. 4 is a perspective view of the mounting bracket of FIG. 1 mounted on a wall.

A bore 4 is provided in the wall plate 1 that serves to retain a fastening element 5 shown in FIGS. 3 and 4, for example, a screw 5, with which the mounting bracket 100 may be attached to a portion of a wall 9 of a building. The actual wall plate 1 comprises an upper area 10 and a lower area 11, whereby the support plate 3 or 3*a* is formed at the transition between the upper and lower areas. This ensures the necessary strength of the mounting bracket. A reinforced area 3B having thicker material may be provided on the horizontal support plate 3 or 3A. Similarly, a reinforced area 2A may be provide on the vertical reinforcing plate 2.

The mounting bracket is advantageously made of plastic, so that it is easy to shorten the overall length of the mounting bracket, to compensate for unevenness in the building wall 9. A mounting flange 6 that extends forward beyond the length of the support plate may be formed at the front end of the mounting bracket, with bores 7, 8 that may be used to fasten the mounting bracket 100 to battens 12 shown in FIGS. 5 and 6. The façade panels 15 shown in FIG. 6 may then be fastened to the battens 12.

The mounting bracket is advantageously made of plastic, so that it is easy to shorten the overall length of the mounting bracket, to compensate for unevenness in the building wall 9. A mounting flange 6 that extends forward beyond the length of the support plate may be formed at the front end of the mounting bracket, with bores 7, 8 that may be used to fasten the mounting bracket 100 to roof battens 12 shown in FIGS. 5 and 6. The façade panels 15 shown in FIG. 6 may then be fastened to the roof battens 12.

Corresponding bores 7 and 8 are provided in the mounting flange 6, or are drilled there, something that is easily possible because the mounting bracket 100 is made of plastic.

Figure 5:
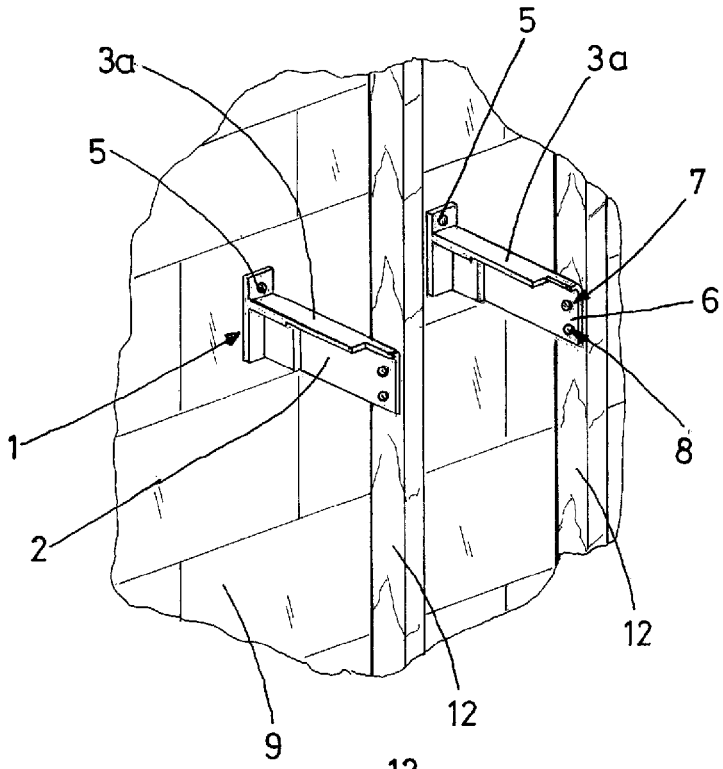
FIG. 5 is an illustration of mounting brackets of FIG. 2 mounted on a wall and attached to roof battens.
Figure 6:
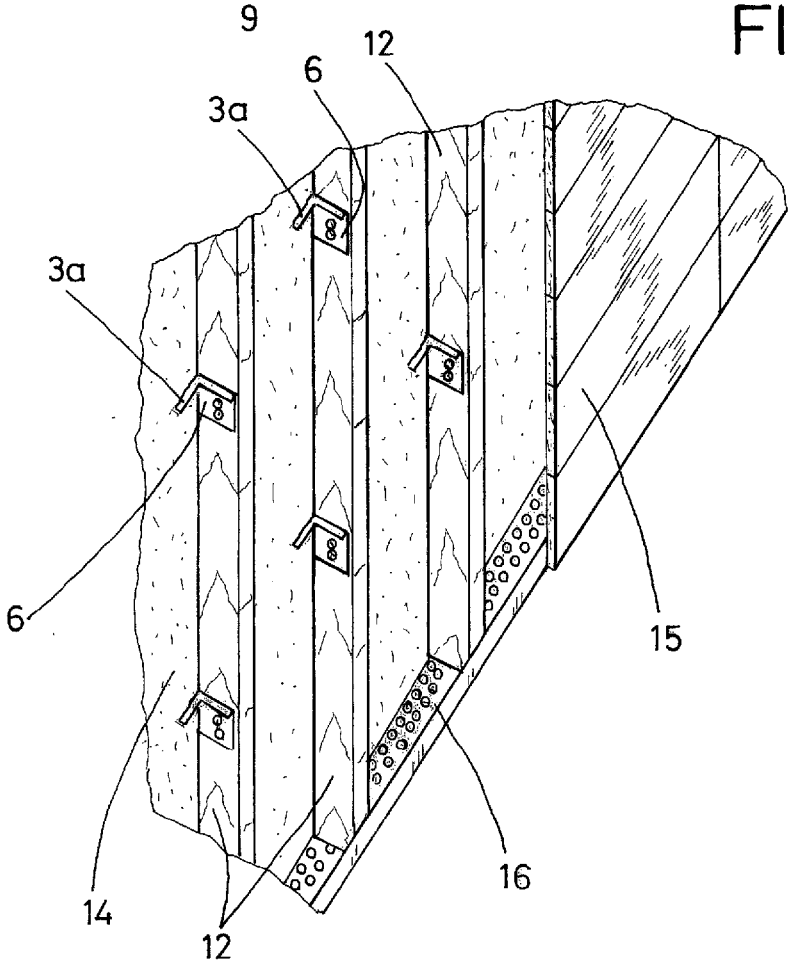
FIG. 6 is an illustration of verntilated wall insulation and façade construction, showing a plurality of the mounting bracket of FIG. 2 installed and attached to roof battens, with insulation material installed over the mounting brackets.

A section of a building wall 9 that is or is to be insulated may be seen in FIGS. 5 and 6. The mounting bracket is fastened to the building wall 9, which, for example, is made of stone, by means of the wall plate 1, then cut to the proper length, in order to even out existing surface irregularities in the building wall 9 if necessary.

The battens 12 are then fastened to the mounting brackets, that is, to the mounting flange. The battens 12 serve to secure the insulation panels 14, and, at the same time, to secure the façade panels 15, as partially shown in FIG. 6. The battens 12 hereby define the clearance for the rear ventilation between the insulation 14 and the façade panels 15.

Roof battens 12 are then fastened to the mounting brackets, that is, to the mounting flange. The roof battens 12 serve to secure the insulation panels 14, and, at the same time, to secure the façade panels 15, as partially shown in FIG. 6. The roof battens 12 hereby define the clearance for the rear ventilation between the insulation 14 and the façade panels 15.

The mounting bracket is constructed as a single component. The combination of the mounting bracket with standard battens 12 is very cost-effective. The mounting bracket allows for length adjustment, to accommodate structural irregularities of the underlying wall and is highly suitable for supporting heavy-grade insulation thicknesses. Making the mounting bracket in plastic avoids thermal bridges. Preferably, the mounting bracket is initially made a bit longer than necessary, relative to the thickness of the planned insulation panels or mats, to allow for a length adjust so that irregularities in the masonry can be evened out and, prior to insulating, also to provide sufficient material to allow battens to be fastened to the bracket.

The mounting bracket is constructed as a single component. The combination of the mounting bracket with standard roof battens 12 is very cost-effective. The mounting bracket allows for length adjustment, to accommodate structural irregularities of the underlying wall and is highly suitable for supporting heavy-grade insulation thicknesses. Making the mounting bracket in plastic avoids thermal bridges. Preferably, the mounting bracket is initially made a bit longer than necessary, relative to the thickness of the planned insulation panels or mats, to allow for a length adjust so that irregularities in the masonry can be evened out and, prior to insulating, also to provide sufficient material to allow roof battens to be fastened to the bracket.

The invention claimed is:

1. A mounting bracket for mounting wall insulation to a wall and to a batten, the mounting bracket comprising:

a unitary piece constructed of a plastic material, the unitary piece including a wall plate for fastening the piece to the exterior wall, a vertical reinforcing plate that extends orthogonal to the wall plate and which has a mounting flange that is fastenable to the batten, and a horizontal support plate that extends orthogonal to the reinforcing plate and the wall plate;

wherein the support plate is above and is strengthened by the reinforcing plate;

wherein the support plate extends beyond both sides of the reinforcing plate, such that the reinforcing plate and the support plate form a T-profile;

wherein the wall plate includes an upper area that extends above and a lower area that extends below the support plate; and wherein the vertical reinforcing plate has a length greater than a length of the support plate, so as to provide an insulation support surface that does not extend over the mounting flange.

2. The mounting bracket of claim 1, wherein the reinforcing plate has a reinforced section that extends along the reinforcing plate from the wall plate for a partial distance of the reinforcing plate toward the mounting flange.

3. The mounting bracket of claim 1, wherein mounting bores are provided in the mounting flange.

4. The mounting bracket of claim 1, wherein the support plate joins with the wall plate so as to form an unobstructed area above the support plate for supporting the wall insulation.

5. The mounting bracket of claim 1, wherein a throughbore is provided in the wall plate in the upper area for receiving a means for fastening the unitary piece to the wall.

6. The mounting bracket of claim 1, wherein the support plate has a free end and a reinforced section that extends along the support plate from the wall plate for a partial distance toward the free end.

7. The mounting bracket of claim 1, wherein the upper area has a greater thickness than the lower area.

* * * * *